US011272765B2

(12) United States Patent
Corelli et al.

(10) Patent No.: US 11,272,765 B2
(45) Date of Patent: Mar. 15, 2022

(54) JEWELRY ITEM AND METHODS OF USE

(71) Applicant: C.C.Couture LLC, Ridgefield, CT (US)

(72) Inventors: Dana Corelli, Stamford, CT (US); Mary Carr, New Rochelle, NY (US)

(73) Assignee: C.C.Couture LLC, Ridgefield, CT (US)

( * ) Notice: Subject to any disclaimer, the term of this patent is extended or adjusted under 35 U.S.C. 154(b) by 0 days.

(21) Appl. No.: 16/927,029

(22) Filed: Jul. 13, 2020

(65) Prior Publication Data

US 2022/0007795 A1 Jan. 13, 2022

(51) Int. Cl.

| | |
|---|---|
| ***A44C 1/00*** | (2006.01) |
| *A44C 15/00* | (2006.01) |
| *A44C 5/00* | (2006.01) |

(52) U.S. Cl.

CPC ..... *A44C 1/00* (2013.01); *A44C 5/00* (2013.01); *A44C 15/005* (2013.01); *A44C 15/0085* (2013.01)

(58) Field of Classification Search

CPC ..... Y10T 24/44291; Y10T 24/44376; Y10T 24/44385; Y10T 24/44453; A44C 13/00; A44C 5/2095; A44C 11/00; A44C 11/005; A44C 1/00; A44C 5/00; A44C 15/005; A44C 15/0085

See application file for complete search history.

(56) References Cited

U.S. PATENT DOCUMENTS

| | | | | |
|---|---|---|---|---|
| 2007/0095101 | A1* | 5/2007 | Pons | A44C 11/002 63/3.1 |
| 2007/0251268 | A1* | 11/2007 | Gisser | A44C 1/00 63/1.11 |
| 2012/0324710 | A1* | 12/2012 | Panopoulos | A41F 1/00 29/525.03 |

FOREIGN PATENT DOCUMENTS

| | | | | |
|---|---|---|---|---|
| DE | 29606163 U1 | * | 6/1996 | A44C 1/00 |
| FR | 787275 A | * | 9/1935 | A45D 8/24 |
| KR | 20140000957 U | * | 2/2014 | |
| WO | WO-2019140714 A1 | * | 7/2019 | A44C 1/00 |

* cited by examiner

*Primary Examiner* — Jack W Lavinder

(74) *Attorney, Agent, or Firm* — Gordon & Jacobson, P.C.

(57) ABSTRACT

A jewelry clip has top and bottom non-marring gripping jaws and an adornment covering the top jaw. The jewelry clip is used to construct at least two different jewelry items such as a bracelet, a necklace, a belt, an anklet, or a choker from an elongate flexible item of at least eighteen inches in length such as a string of beads or pearls, a chain, or a piece of fabric by securing the item at two locations in a first format, and at two locations, including at least one different location in a second format.

15 Claims, 8 Drawing Sheets

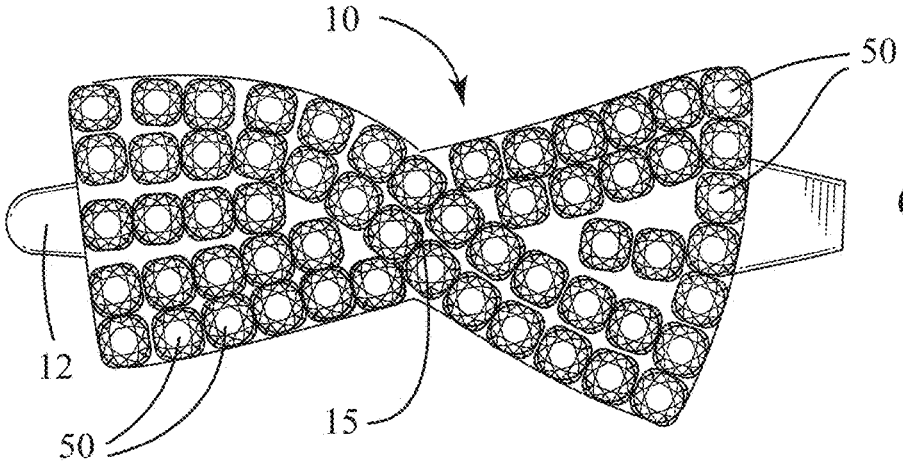
Fig. 2
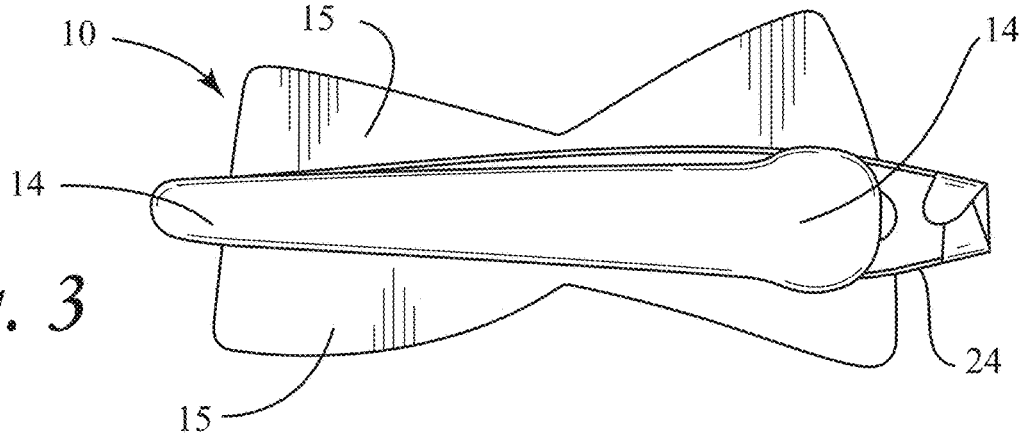
Fig. 3
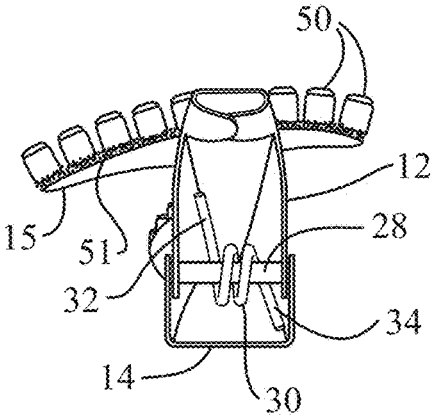
Fig. 4
Fig. 5
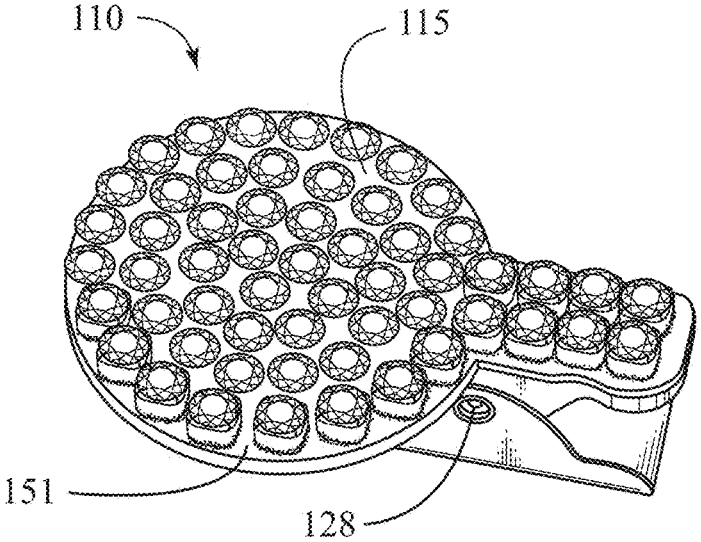

JEWELRY ITEM AND METHODS OF USE

BACKGROUND

1. Field

The present disclosure relates to jewelry. More particularly, the present disclosure relates to an item of jewelry that may be used to transform other items such as a string of beads or a chain necklace into a multiple of different stylish items such as a bracelet, a choker, a necklace, an anklet, etc.

2. State of the Art

Jewelry has a very long history dating back tens of thousands of years. Generally, jewelry may be defined as a decorative or ornamental item that may be attached to the body or to clothes and worn for personal adornment. Jewelry is most often formed of metal, including precious metal, and/or of stone, including semi-precious and precious (gem) stones. "Costume jewelry" dates back to the early twentieth century and mimics jewelry made of precious metals and gemstones, but utilizes inexpensive simulated gemstones (e.g., plastic or acrylic) and inexpensive and/or plated metal.

Jewelry has been used for purposes of establishing status. Jewelry has also been used for purposes of style. In many societies, affluent individuals may have many pieces of jewelry which are used for their own exclusive purposes, including rings, earrings, necklaces, brooches, bracelets, etc.

SUMMARY

A jewelry clip is provided having top and bottom gripping jaws with at least one jaw having non-marring teeth on one end which are spring-loaded into a closed position, and adornment affixed to the top jaw, where the adornment covers and hides substantially all of the jaw. The adornment may include one or more precious, semi-precious or simulated gemstones.

In one embodiment, the jaws of the jewelry clip are about 1 inch to 1.5 inches in length and assume an approximately ten-degree angle relative to each other when fully closed and an approximately twenty-degree angle relative to each other when fully open. The top jaw may be slightly longer than the bottom jaw (behind a pivot) to permit extra leverage. The teeth extend about one-quarter inch to one-third inch at the end of the clip. In one embodiment, only the top jaw has teeth. In another embodiment, both jaws have teeth that mesh.

According to methods, the jewelry clip is used in a multifunctional manner. Thus, the jewelry clip is used to clip together, at two locations, an elongate flexible item such as a strand of beads, pearls, a metal chain, or a piece of fabric so as to cause the elongate flexible item to assume a first jewelry format such a bracelet, a choker, a necklace, or an anklet. After use in a first format, the jewelry clip is opened to release the elongate flexible item. The jewelry clip is then used to clip the same elongate flexible item together at two locations (including at least one different location than the original clipping locations) so as to cause the elongate flexible item to assume a second different jewelry format. In this manner, the jewelry clip is able to transform a single (jewelry) item into multiple jewelry items.

Because the jewelry clip includes gripping jaws with at least one jaw having non-marring teeth, where the jaws can rotate approximately thirty degrees relative to each other, the clip is useful to clip together at two locations an elongate flexible item such as a string of beads, a chain, or a piece of fabric without causing damage to the item.

BRIEF DESCRIPTION OF THE DRAWINGS

FIG. 2 is a top view of the jewelry clip of FIG. 1.

FIG. 3 a bottom view of the jewelry clip of FIG. 1.

FIG. 4 is a back view of the jewelry clip of FIG. 1 in a closed position.

FIG. 5 is a top perspective view from a first angle of a second embodiment of a jewelry clip in a closed position.

DETAILED DESCRIPTION OF EMBODIMENTS

Figure 1:
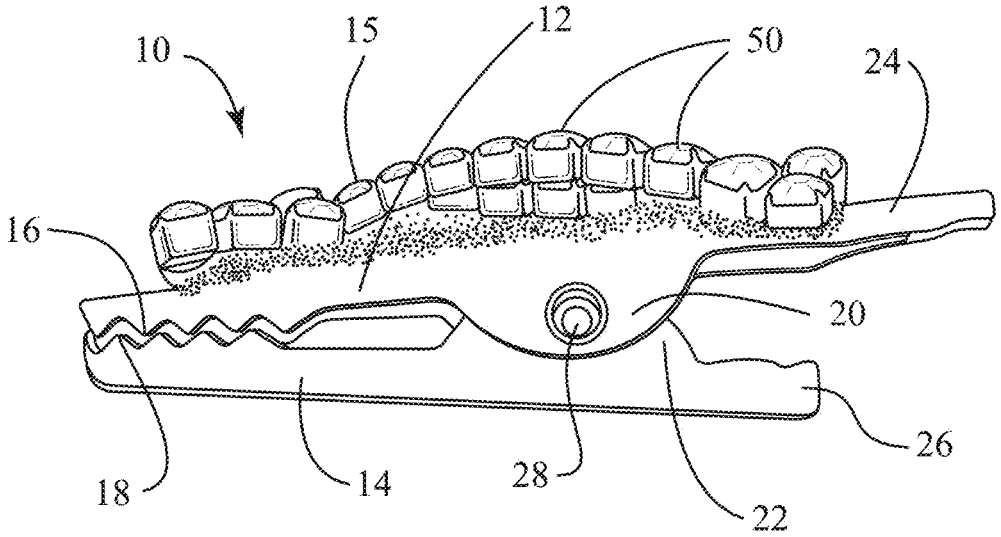
FIG. 1 is a side view of an embodiment of a jewelry clip in a closed position.

Turning to FIGS. 1-4, a first embodiment of a jewelry clip 10 is seen. The clip 10 includes top and bottom gripping jaws 12, 14, and an adornment 15. The gripping jaws 12, 14 have non-marring meshing teeth 16, 18 on one end, fulcrum extensions 20, 22 in a middle section, and lever extensions 24, 26 on the end opposite the teeth. A pin or post 28 (FIG. 1) joins the jaws together at their overlapping fulcrum extensions 20, 22, and a torsion spring 30 (FIG. 4) loops around the post 18 and has respective ends 32, 34 that engage the respective inside surfaces of the respective fulcrum extensions 20, 22 and/or the inside surfaces of the lever extensions. The fulcrum extensions and/or the lever extensions may include lips (edges) to help keep the torsion spring ends in place. The torsion spring 30 spring loads (biases) the jaws 12, 14 into a closed position where the teeth 16, 18 meet and mesh. The teeth 16, 18 are formed on the edges of the jaws such that a hollow is defined in each jaw between the teeth. When the jaws are closed, the meshed teeth form an enclosure around a hollow. In the jewelry clip 10, top jaw 12 is shown with five teeth (on each side), while the bottom jaw 14 is shown with four teeth (on each side) and a front tooth extending in the middle.

In embodiments, the jaws 12, 14 of the jewelry clip 10 are about 1 inch to 1.5 inches in total length and assume an approximately ten-degree angle relative to each other when fully closed (i.e., the teeth meet) and an approximately twenty-degree angle relative to each other when fully open (i.e., when the lever extensions 24, 26 are fully pressed against the force of the spring 30), for a thirty degree swing between fully closed and open positions. The top jaw may be slightly longer than the bottom jaw (behind the pivot post 28) to permit extra leverage. The meshing teeth 16, 18 extend about one-quarter inch to one-third inch at the gripping end of the clip 10.

The adornment 15 is affixed to the top jaw 12 to obscure (hide) substantially all (80% or more) of the jaw 12. The adornment may include one or more precious, semi-precious or simulated gemstones. The jewelry clip 10 is shown with an adornment 15 made from between forty and fifty rhinestones 50 (simulating diamonds) that are shaped into a bow. The bow may have three-dimensionality, by having rhinestones crossing over each other as suggested by FIGS. 1 and 2. The rhinestones are connected to each other by a grid of aluminum holders 51 with at least some of the holders being affixed to the top jaw 12, e.g., by glue or by solder, laser welding or other welding.

Figure 6:
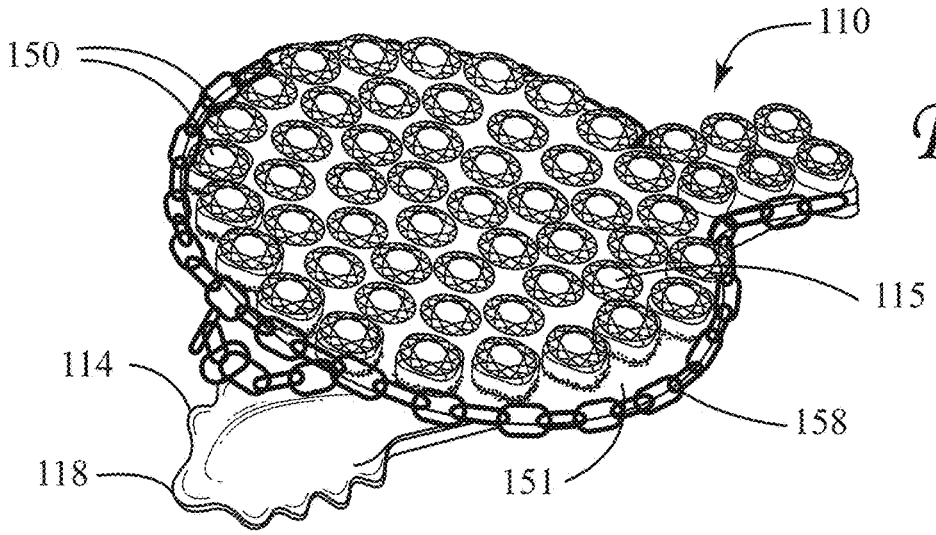
FIG. 6 is a top perspective view from a second angle of the jewelry clip of FIG. 5, slightly modified, with the jaws open.
Figure 7:
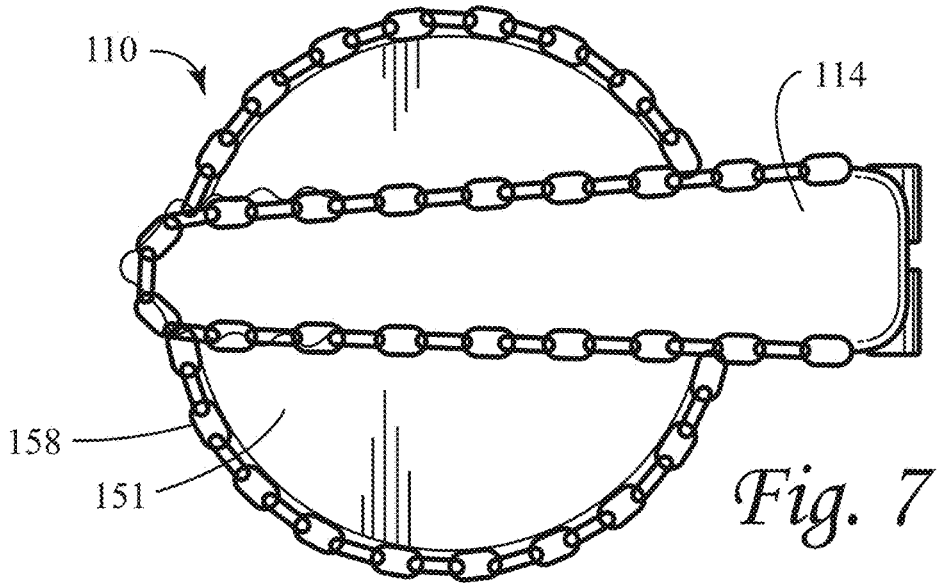
FIG. 7 is a bottom view of the jewelry clip of FIG. 6 with the jaws closed.
Figure 8:
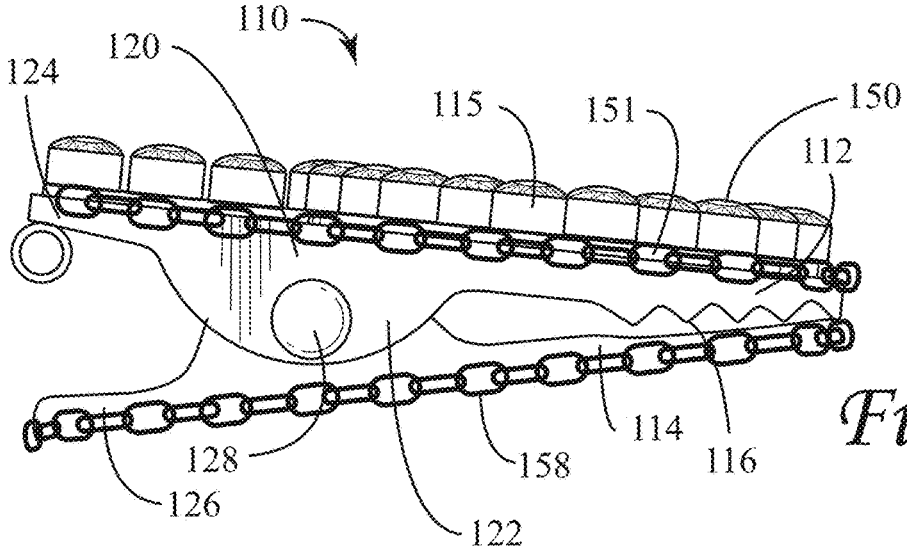
FIG. 8 is a side view of the jewelry clip of FIG. 6 with the jaws closed.
Figure 6A:
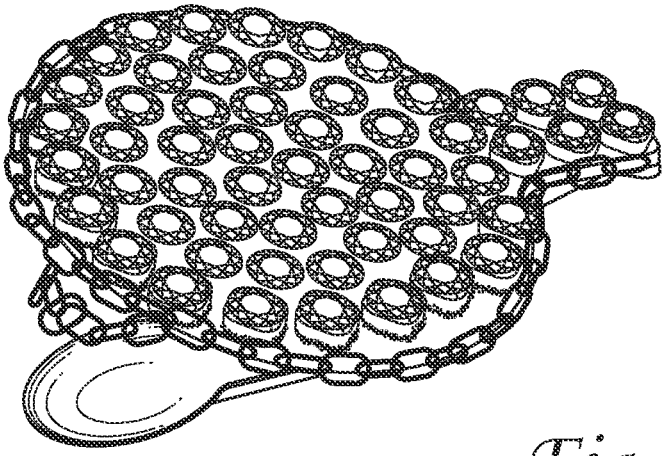
FIG. 6A is a top perspective view from a second angle of the jewelry clip of FIG. 5, slightly modified, with a bottom jaw without teeth and with the jaws open.

FIG. 5 is a top perspective view of a second embodiment of a jewelry clip 110 in a closed position, while FIGS. 6-8 show the same clip 110 (slightly modified as described below) from a top perspective view with the jaws open, from a bottom view with the jaws closed, and from a side view with the jaws closed respectively. The clip 110 includes top and bottom gripping jaws 112, 114, and an adornment 115. Gripping jaw 112 has non-marring gripping teeth 116 while gripping jaw 114 either has no teeth (as shown in FIG. 6A) or flattened teeth 118 (e.g., as seen in FIG. 6) which appear as a slight serration or adornment on one end. The provision of only one jaw with gripping teeth is found to be advantageous in many circumstances to prevent damage to sensitive fabrics and threads. The jaws 112, 114 have fulcrum extensions 120, 122 in a middle section, and lever extensions 124, 126 on the end opposite the teeth. A pin or post 128 joins the jaws together at their overlapping fulcrum extensions 120, 122, and a torsion spring (such as shown in the embodiment of FIG. 3) loops around the post and has respective ends that engage the respective inside surfaces of the respective fulcrum extensions 120, 122 and/or the inside surfaces of the lever extensions. The fulcrum extensions and/or the lever extensions may include lips (edges) to help keep the torsion spring ends in place. The torsion spring spring-loads (biases) the jaws 112, 114 into a closed position where the teeth 116 of jaw 112 meet jaw 114.

In embodiments, the jaws 112, 114 of the jewelry clip 110 are about 1 inch to 1.5 inches in total length and assume an approximately ten-degree angle relative to each other when fully closed and an approximately twenty-degree angle relative to each other when fully open (i.e., when the lever extensions 124, 126 are fully pressed against the force of the spring). The top jaw may be slightly longer than the bottom jaw (behind the pivot post 128), if desired, to permit extra leverage, although it not shown that way in the Figures. The teeth 116 of jaw 112 extend about one-quarter inch to one-third inch at the gripping end of the clip 110.

The adornment 115 is affixed to the top jaw 112 to obscure (hide) substantially all (80% or more) of the jaw. The adornment may include one or more precious, semi-precious or simulated gemstones. Adornment 115 is a substantially circular metal plate 151 having an extending arm that extends over the lever portion of the top gripping jaw, with rhinestones 150 (simulating diamonds) covering the plate. In this manner, substantially 100% of the top surface of the jaw is covered with the adornment. The rhinestones are connected to each other by a grid of aluminum holders with at least some of the holders being affixed to plate 151 by glue, solder, laser welding, or other means. Plate 151 is likewise affixed to top jaw 112 by glue, solder, laser welding, or other means. As shown in FIGS. 6-8, the edges of the adornment 115 may be provided with additional adornment 158 in the form of filigree or chain loops. The sides of one or both jaws 112, 114 may likewise be adorned. Furthermore, the back of the bottom jaw 114 may also be adorned, as may the back of the adornment 115. The back-side adornment may be made by etching or applying the adornment by glue, solder, welding or otherwise.

Figure 9:
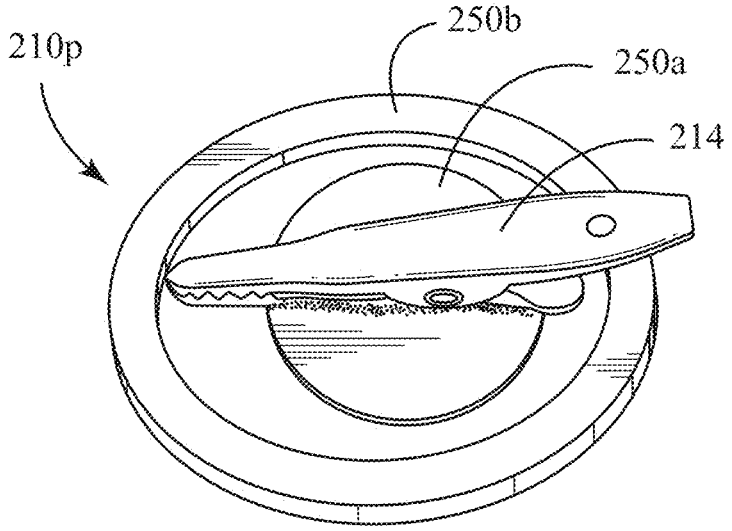
FIG. 9 is a bottom perspective view of a third embodiment of a jewelry clip in a closed position.
Figure 10:
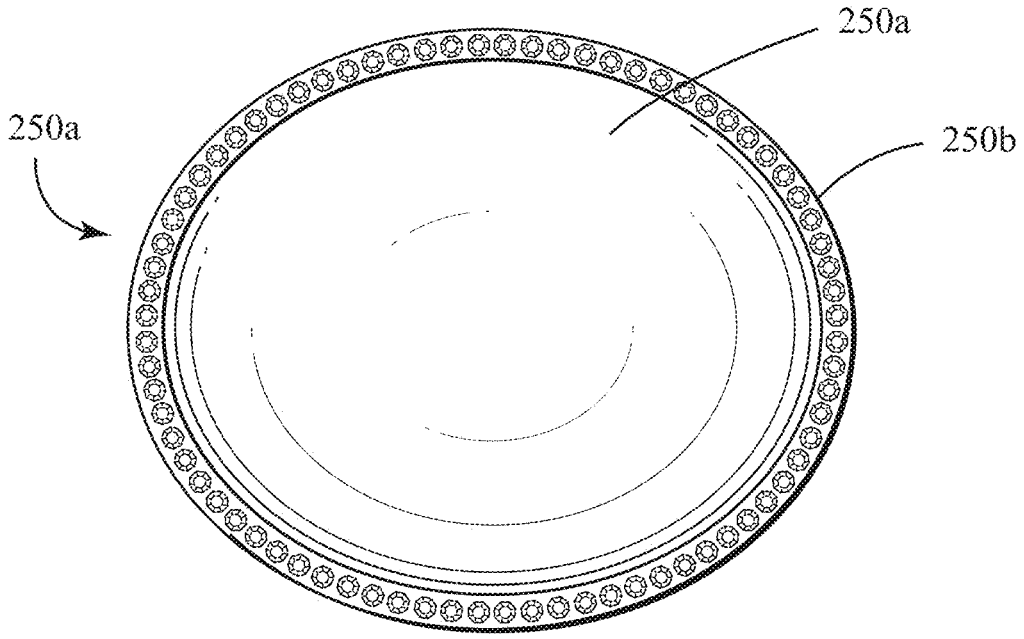
FIG. 10 is a top view of the jewelry clip of FIG. 9.

FIGS. 9 and 10 are respectively bottom perspective and top views of a third embodiment of a jewelry clip 210 in a closed position. The bottom jaw 214 of clip 210 is seen in FIG. 9. The top jaw of clip 210 is completely covered by the adornment 250 which includes a stone 250*a* in a frame 250*b*. The adornment 250 is glued to the top jaw of the clip.

In one embodiment applicable to any of the previously-described clips, the teeth of the top and/or bottom jaw may be laminated with a resin or plastic. The laminate may be clear and protective and protect against scratching, marking, and damage.

In one aspect, the previously-described clips have advantages without any additional elements provided thereto; i.e., the clips consist of the jaws, the post, the spring, and the adornment.

Figure 11A:
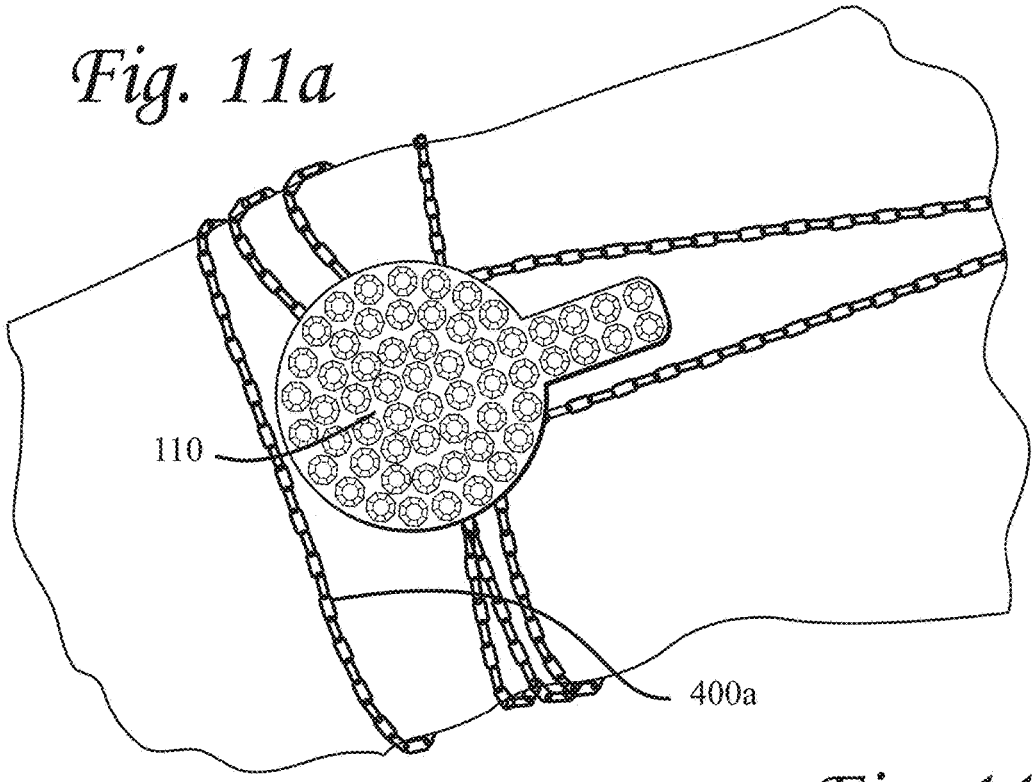
FIG. 11*a* is a perspective view of the jewelry clip of FIG. 5 being used in conjunction with a chain to form a bracelet.
Figure 11B:
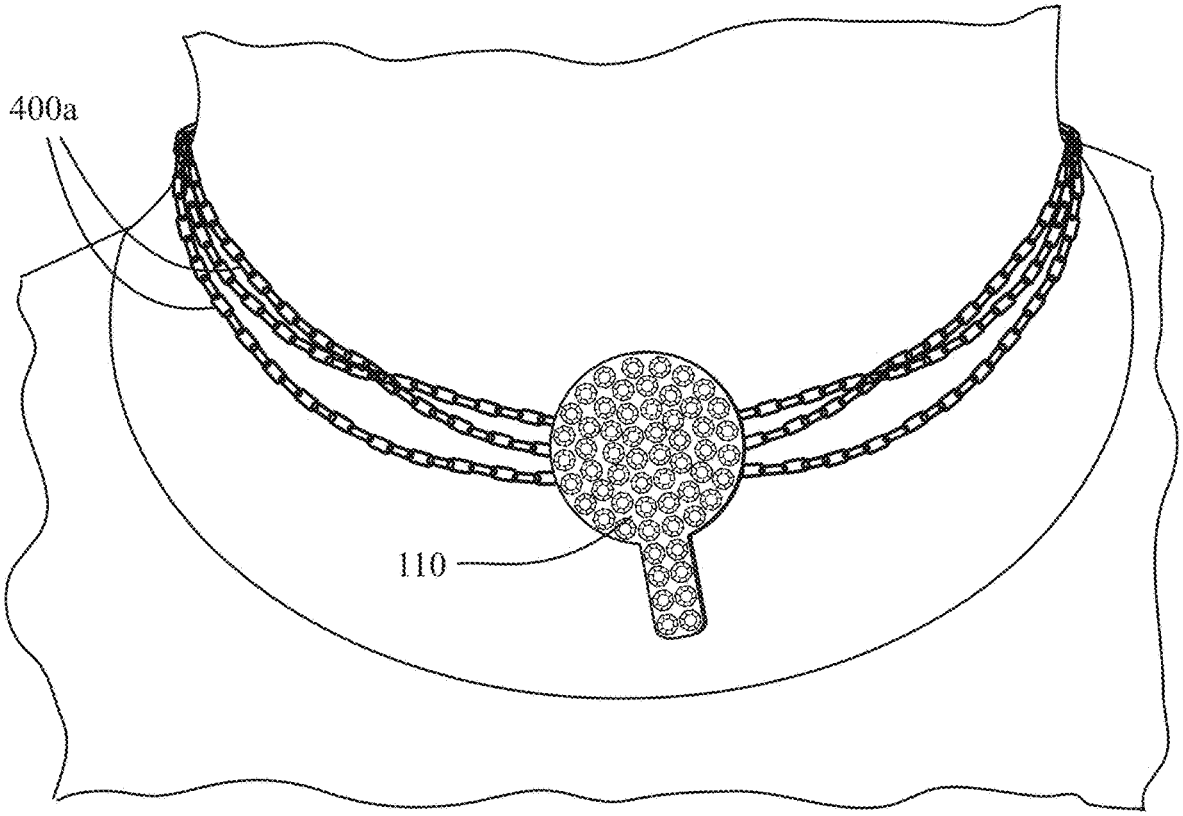
FIG. 11*b* is a perspective view of the jewelry clip of FIG. 5 being used in conjunction with the chain of FIG. 11*a* to form a choker.
Figure 11C:
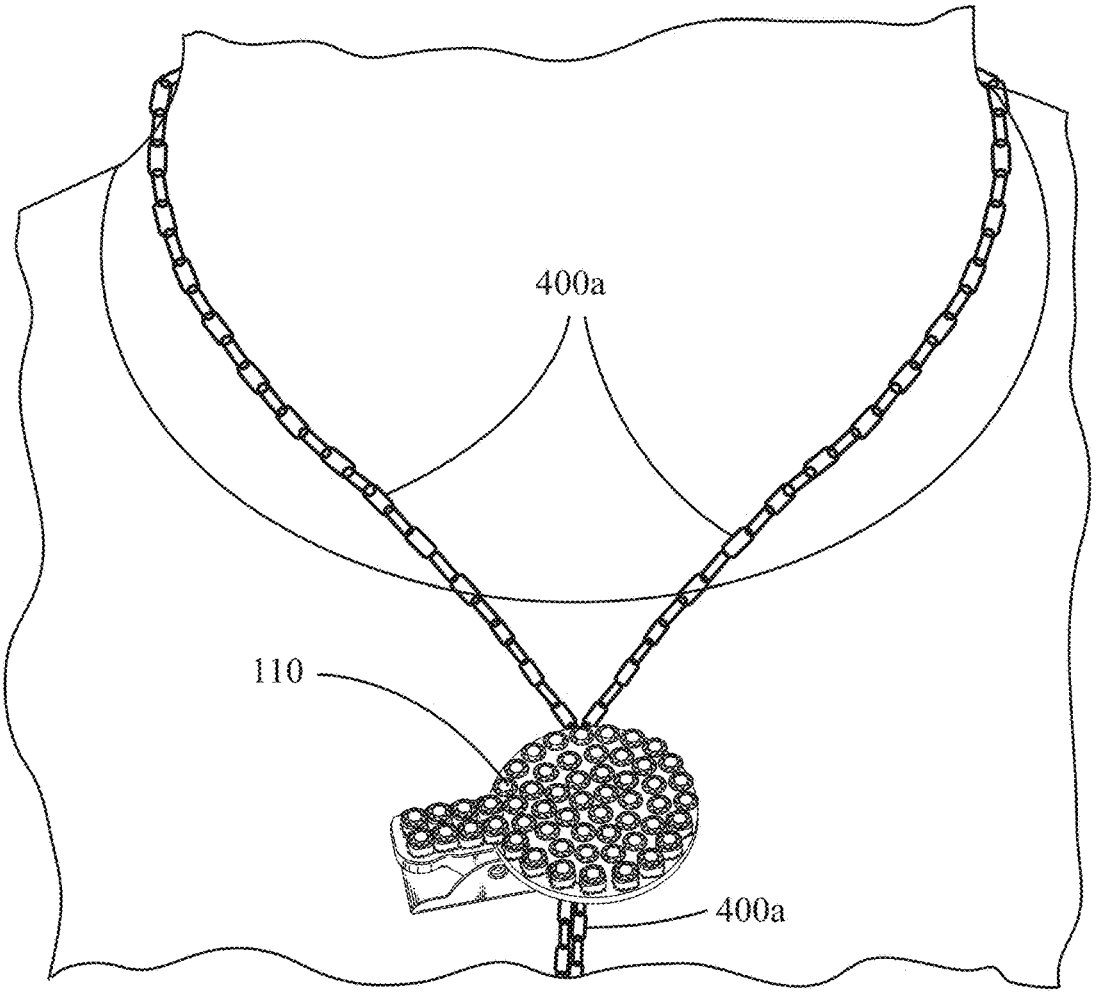
FIG. 11*c* is a perspective view of the jewelry clip of FIG. 5 being used in conjunction with the chain of FIG. 11*a* to form a necklace.
Figure 11D:
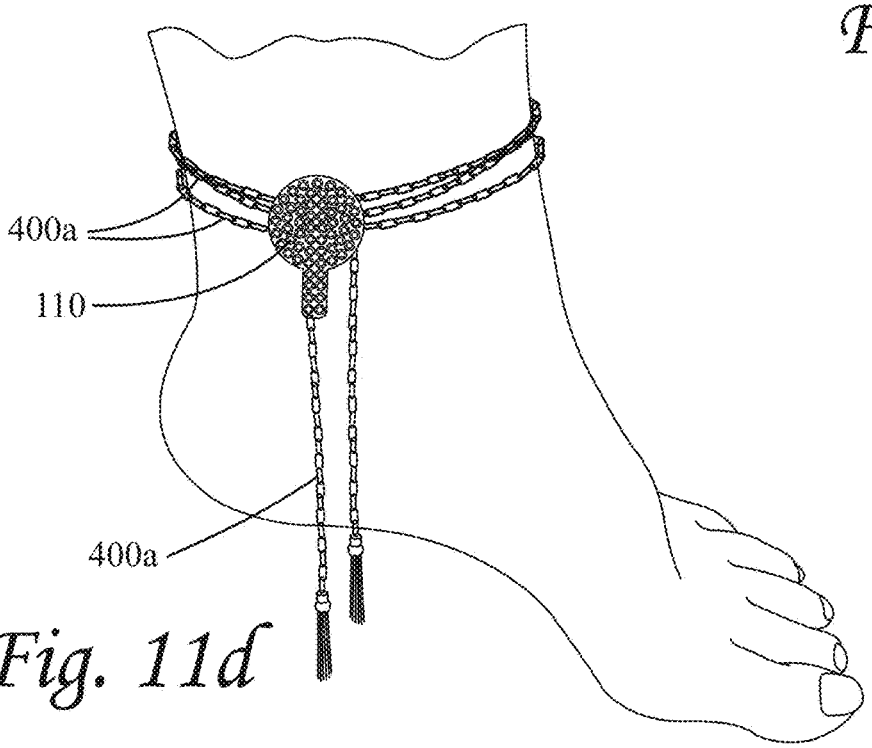
FIG. 11*d* is a perspective view of the jewelry clip of FIG. 5 being used in conjunction with the chain of FIG. 11*a* to form an anklet.

According to methods, each the jewelry clips 10, 110, 210 may be used in a multifunctional manner. Thus, the jewelry clip is used to secure together an elongate flexible item of typically eighteen inches long or longer (e.g., twenty-four inches, thirty inches, thirty-six inches, forty-two inches, or longer) such as a strand of beads or pearls, a metal chain, or a piece of fabric (e.g., silk or velvet) at two locations so as to cause the elongate flexible item to assume a first jewelry format such a bracelet, a choker, a necklace, a belt, or an anklet. The two locations may be near or at the end of the elongate item, or one of the locations may be near the end of the elongate item and one may somewhere other than the other end, or both locations may be at locations other than at the ends. After using the clip to assume a first format, the clip may be removed. The elongate item may then be located at another location on the body of the user (e.g., the leg, arm, or neck), and the clip used again so that the elongate flexible strand assumes a different jewelry format. In the second format, the clip will be located at one or two different locations along the elongate item. In this manner, the jewelry clip is able to transform a single (jewelry) item into multiple jewelry items. Thus, as seen in FIG. 11*a*, the jewelry clip 110 of FIG. 5 being used in conjunction with a chain 400*a* to form a bracelet. Chain 400*a* is seen wrapped multiple times around a wrist of a user and clipped together with the clip 110. In FIG. 11*b* the same jewelry clip 110 is being used in conjunction with the same chain 400*a* to form a choker around the neck of the user. Here, the clip 110 is clipping different locations of the chain 400*a* than what is shown in FIG. 11*a*. In FIG. 11*c* the same jewelry clip 110 is being used with the same chain 400*a* to form a necklace. Again, the clip 110 is shown clipping different locations of the chain 400*a* than what is shown in FIGS. 11*a* or 11*b*. In FIG. 11*d*, the same jewelry clip 110 is being used with the same chain 400*a* to form an anklet. Again, the clip 110 is shown clipping different locations of the chain 400*a* than what is shown in FIG. 11*a*, 11*b* or 11*c*.

Figure 12B:
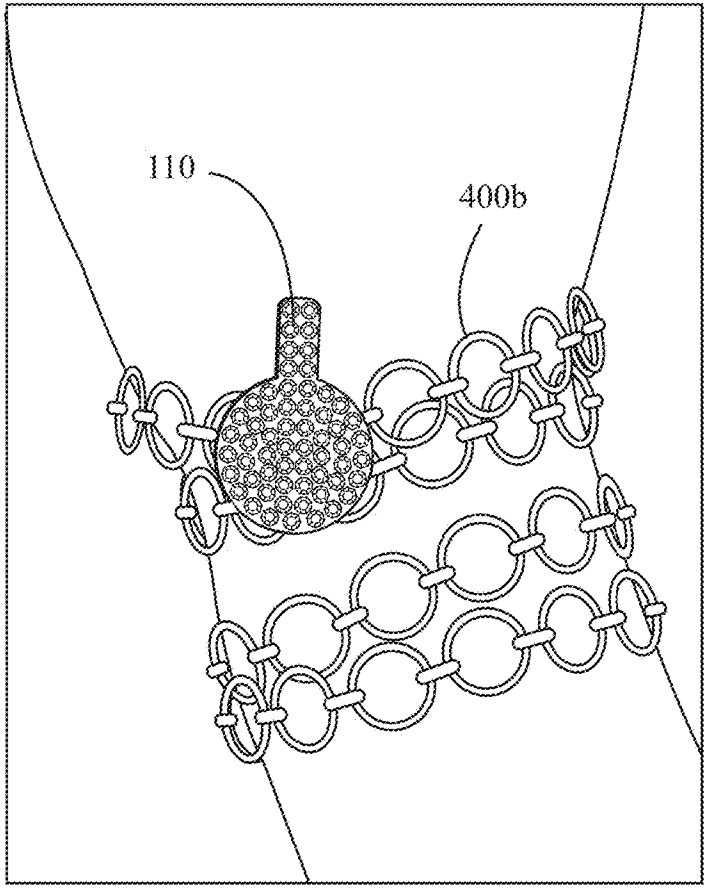
FIG. 12*b* is a perspective view of the jewelry clip of FIG. 5 being used in conjunction with the chain of FIG. 12*a* to form a bracelet.
Figure 12A:
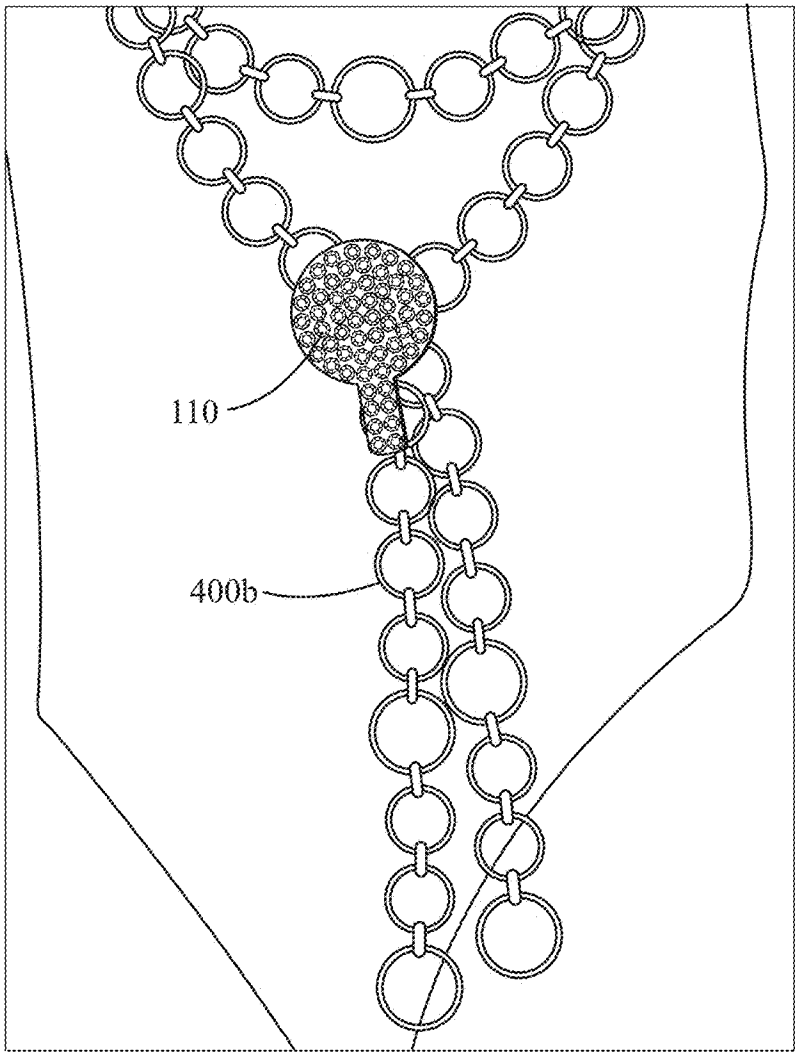
FIG. 12*a* is a perspective view of the jewelry clip of FIG. 5 being used in conjunction with a chain to form a necklace.

FIGS. 12*a*-12*b* show the jewelry clip 110 of FIG. 5 being used in conjunction with a loop chain 400*b*. In FIG. 12*a*, the jewelry clip 110 and the loop chain 400*b* are being used to form a necklace or choker around the neck of the user. In FIG. 12*b*, the loop chain is seen wrapped multiple times around a wrist of a user and clipped together to form a bracelet with the clip 110 shown attached at a different location of the loop chain 400*b* than what is shown in FIG. 12*a*.

There have been described and illustrated herein several embodiments of a jewelry clip and a method of its use. While particular embodiments have been described, it is not intended that the invention be limited thereto, as it is intended that the invention be as broad in scope as the art will allow and that the specification be read likewise. Thus, while jewelry clips have been shown with two jaws with meshing teeth, or with a top jaw with teeth and a bottom jaw without teeth, it will be appreciated that the bottom jaw could have the teeth and the top jaw could be without teeth, as teeth are required on only one of the jaws. Also, while, in one embodiment, a plate to which stones may be attached is provided as part of an adornment, it will be appreciated that other intermediary elements or no intermediary elements may be used between the stones and the gripping jaw. It will therefore be appreciated by those skilled in the art that yet other modifications could be made to the provided invention without deviating from its spirit and scope as claimed.

What is claimed is:

1. A jewelry clip, comprising:

top and bottom gripping jaws, with the top gripping jaws having non-marring teeth on a gripping end and the bottom gripping jaw not including teeth on its gripping end, and each having fulcrum extensions in a middle section and lever extensions on an end opposite the gripping end, wherein the fulcrum extensions overlap;

a post joining the jaws together at their overlapping fulcrum extensions;

a torsion spring looping around the post and engaging respective inside surfaces of the respective fulcrum extensions, said torsion spring biasing the jaws into a closed position; and an adornment affixed to the top jaw and obscuring substantially all of the top jaw in a top-side view.

2. The jewelry clip according to claim 1, wherein the jaws are each approximately 1 inch to 1.5 inches in total length, and the jaws assume an approximately ten-degree angle relative to each other in said closed position and an approximately twenty-degree angle relative to each other in a fully open position.

3. The jewelry clip according to claim 2 wherein the teeth extend between one-quarter inch and one-third inch along the gripping end.

4. The jewelry clip of claim 1, wherein the adornment comprises one or more precious, semi-precious or simulated gemstones.

5. The jewelry clip of claim 4, wherein the adornment further comprises a plate located between and affixed to said top jaw, and said one or more precious, semi-precious or simulated gemstones are affixed to said t-e jaw by being affixed to said plate.

6. A jewelry clip consisting of:

top and bottom gripping jaws, at least one of said top and bottom gripping jaws having non-marring teeth extending between one-quarter inch and one-third inch along a gripping end, with the top and bottom gripping jaws each having fulcrum extensions in a middle section and lever extensions on an end opposite the teeth, wherein the fulcrum extensions overlap;

a post joining the jaws together at their overlapping fulcrum extensions;

a torsion spring looping around the post and engaging respective inside surfaces of the respective fulcrum extensions, said torsion spring biasing the jaws into a closed position; and an adornment affixed to the top jaw and obscuring substantially all of the top jaw from a top view.

7. The jewelry clip according to claim 6, wherein the jaws are each approximately 1 inch to 1.5 inches in total length, and the jaws assume an approximately ten-degree angle relative to each other in said closed position and an approximately twenty-degree angle relative to each other in a fully open position.

8. The jewelry clip of claim 6, wherein the top gripping jaw and said bottom gripping jaw both have teeth and said teeth of said top gripping jaw and bottom gripping jaw mesh.

9. The jewelry clip according to claim 6 wherein the adornment comprises one or more precious, semi-precious or simulated gemstones.

10. The jewelry clip according to claim 9, wherein the adornment further comprises a plate located between and affixed to said top jaw, and said one or more precious, semi-precious or simulated gemstones are affixed to said jaw by being affixed to said plate.

11. A jewelry clip consisting of:

top and bottom gripping jaws, wherein the top gripping jaw has non-marring teeth on a gripping end and the bottom gripping jaw does not have teeth, with the top and bottom gripping jaws each having fulcrum extensions in a middle section and lever extensions on an end opposite the teeth, wherein the fulcrum extensions overlap;

a post joining the jaws together at their overlapping fulcrum extensions;

a torsion spring looping around the post and engaging respective inside surfaces of the respective fulcrum extensions, said torsion spring biasing the jaws into a closed position; and an adornment affixed to the top jaw and obscuring substantially all of the top jaw from a top view.

12. The jewelry clip according to claim 11, wherein the adornment comprises one or more precious, semi-precious or simulated gemstones.

13. The jewelry clip according to claim 12, wherein the adornment further comprises a plate located between and affixed to said top jaw, and said one or more precious, semi-precious or simulated gemstones are affixed to said jaw by being affixed to said plate.

14. A method of generating two different items of jewelry, comprising:

obtaining a jewelry clip having top and bottom gripping jaws, with the top gripping jaws having non-marring teeth on a gripping end and the bottom gripping jaw not including teeth on its gripping end, and each having fulcrum extensions in a middle section and lever extensions on an end opposite the gripping end, wherein the fulcrum extensions overlap, a post joining the jaws together at their overlapping fulcrum extensions, a torsion spring looping around the post and engaging respective inside surfaces of the respective fulcrum extensions, said torsion spring biasing the jaws into a closed position, and an adornment affixed to the top jaw and obscuring substantially all of the top jaw;

obtaining an elongate flexible item of at least eighteen inches in length and comprising one of a string of beads, a string of pearls, a chain, and a piece of fabric;

placing the elongate flexible item around one of an arm, leg, waist or neck of an individual, and using the jewelry clip to secure the elongate flexible item so that the elongate flexible item assumes a first jewelry format;

removing the jewelry clip from the elongate flexible item;

placing the elongate flexible item around a second of the arm, leg or neck of the individual, and using the jewelry clip to secure the elongate flexible item so that the elongate flexible item assumes a second jewelry format.

15. The method of claim 14, further comprising:

again removing the jewelry clip from the elongate flexible item; and placing the elongate flexible item around one of the arm, leg, waist or neck of the individual and using the jewelry clip to secure the elongate flexible item so that the elongate flexible item assumes a third jewelry format.

* * * * *